US005265653A

United States Patent [19]

Herlth

[11] Patent Number: 5,265,653

[45] Date of Patent: Nov. 30, 1993

[54] PORTABLE PNEUMATIC LIQUID TRANSFER ASSEMBLY

[76] Inventor: August H. Herlth, 156 Old County Rd., Higganum, Conn. 06441

[21] Appl. No.: 977,034

[22] Filed: Nov. 16, 1992

[51] Int. Cl.[5] ..... B65B 3/00

[52] U.S. Cl. ..... 141/65; 141/84; 141/59

[58] Field of Search ..... 141/84, 65, 59, 67

[56] References Cited

U.S. PATENT DOCUMENTS

| | | | |
|---|---|---|---|
| 2,359,162 | 9/1944 | Sherbondy | 141/84 X |
| 3,319,578 | 5/1967 | Ware . | |
| 4,215,725 | 8/1980 | Callet et al. | 141/65 |
| 4,673,006 | 6/1987 | Speck | 141/1 |
| 5,159,961 | 11/1992 | Snetting et al. | 141/65 |
| 5,185,007 | 2/1993 | Middaugh et al. | 141/65 X |

FOREIGN PATENT DOCUMENTS

| | | | |
|---|---|---|---|
| 2123391 | 2/1984 | United Kingdom | 141/65 |

*Primary Examiner*—Ernest G. Cusick
*Attorney, Agent, or Firm*—William W. Jones

[57] ABSTRACT

An assembly for transferring liquids of varying viscosities ranging from that of water to that of oils or greases utilizes a source of compressed air passed through or past a venturi nozzle to create, respectively, a negative or positive pressure in a transfer container. The container is preferably, but not necessarily, a portable bucket, pail or drum having a removable lid, which lid is fitted with all of the assembly operating components, such as the transfer line, the valve assembly, and the like. The valve assembly can be adjusted to direct the stream of compressed air into the bucket to transfer liquid out; or to direct the stream of compressed air through the venturi nozzle, so that air will be drawn out of the bucket, and the liquid will be transferred into the bucket. Manually operable flow controls are included, and a single inlet/outlet line is also preferably used.

20 Claims, 4 Drawing Sheets

PORTABLE PNEUMATIC LIQUID TRANSFER ASSEMBLY

TECHNICAL FIELD

This invention relates to a portable liquid transfer assembly which uses a compressed air stream to transfer liquids such as water, oil, greases, or the like, into and/or out of a portable container.

BACKGROUND ART

The transfer of liquids into and out of a storage or transfer container through the use of a controlled stream of air is known in the prior art. U.S. Pat. No. 3,319,578 Ware discloses a liquid transfer unit which has an adjustable venturi jet vacuum generator that is connected to a supply of compressed air. The venturi has a series of valves that can be set so as to create a negative pressure in an ancillary chamber communicating with a recovery tank whereby liquid will be drawn into the recovery tank; and that can also be set so as to create a positive pressure in the ancillary chamber whereby liquid can be pumped out of the recovery tank.

The recovery tank is provided with an inlet line for transferring the liquid from one container into the tank; and an outlet line for transferring the liquid from the tank to another container. The Ware transfer unit is a complex assembly, having five different valves; two separate transfer lines; a compound container; and is also cumbersome. The use of the compound container creates a problem because the level of the liquid in the recovery tank cannot be allowed to reach the level of the discharge line, or the level of the connection between the recovery tank and the ancillary chamber.

An assembly which operates in accordance with the general principals of the unit disclosed in the Ware patent would have utility in automotive garages for quickly and efficiently transferring radiator fluid, transmission fluid, oil, grease, and the like.

The unit disclosed in the Ware patent has very limited utility because of its size and its complexity. A simplified unit would also have utility in homes, and businesses other than garages.

DISCLOSURE OF THE INVENTION

This invention relates to an improved liquid transfer unit which is portable, and which can be used in conjunction with standard stock liquid containers, such as five, ten, fifteen, or even fifty five gallon oil, grease, or water buckets, pails or drums. The unit of this invention preferably uses a single inlet/outlet line, and a single multifunctional control valve assembly to control air flow, and thus air pressure in the container. The operable components of the unit are all preferably mounted on the container lid, so that a single removable lid can be used with a multitude of different containers. The only requirement is that the lid can be fitted snugly onto each container. The lid-mounted operating components preferably include: the single inlet/outlet line; the multifunctional control valve assembly; a fitting for connection to the source of compressed air; positive and negative pressure-limiting controls; and an automatic shut off which operates when the liquid reaches a predetermined level in the container. When the container lid cannot be readily removed from the container, as with the fifty five gallon drums, the operating components may be removably mounted on the container lid.

It is therefore an object of this invention to provide an improved liquid transfer assembly unit which is portable and can be used to pump water, grease, oil or the like relatively low viscosity liquids into and out of a transfer container.

It is a further object to provide an improved assembly unit of the character described wherein the operating components of the unit are all mounted on a removable container lid which can be fitted onto a plurality of different containers.

It is an additional object of this invention to provide an improved assembly unit of the character described which operates by modifying the pressure inside of the container with a stream of compressed gas, such as compressed air.

It is another object of this invention to provide an improved assembly unit of the character described which utilizes a single inlet/outlet line for transferring the liquid into and out of the container.

These and other objects and advantages will become more readily apparent from the following detailed description of a preferred embodiment of the invention when taken in conjunction with the accompanying drawing in which:

DETAILED DESCRIPTION OF THE BEST MODE

Figure 1:
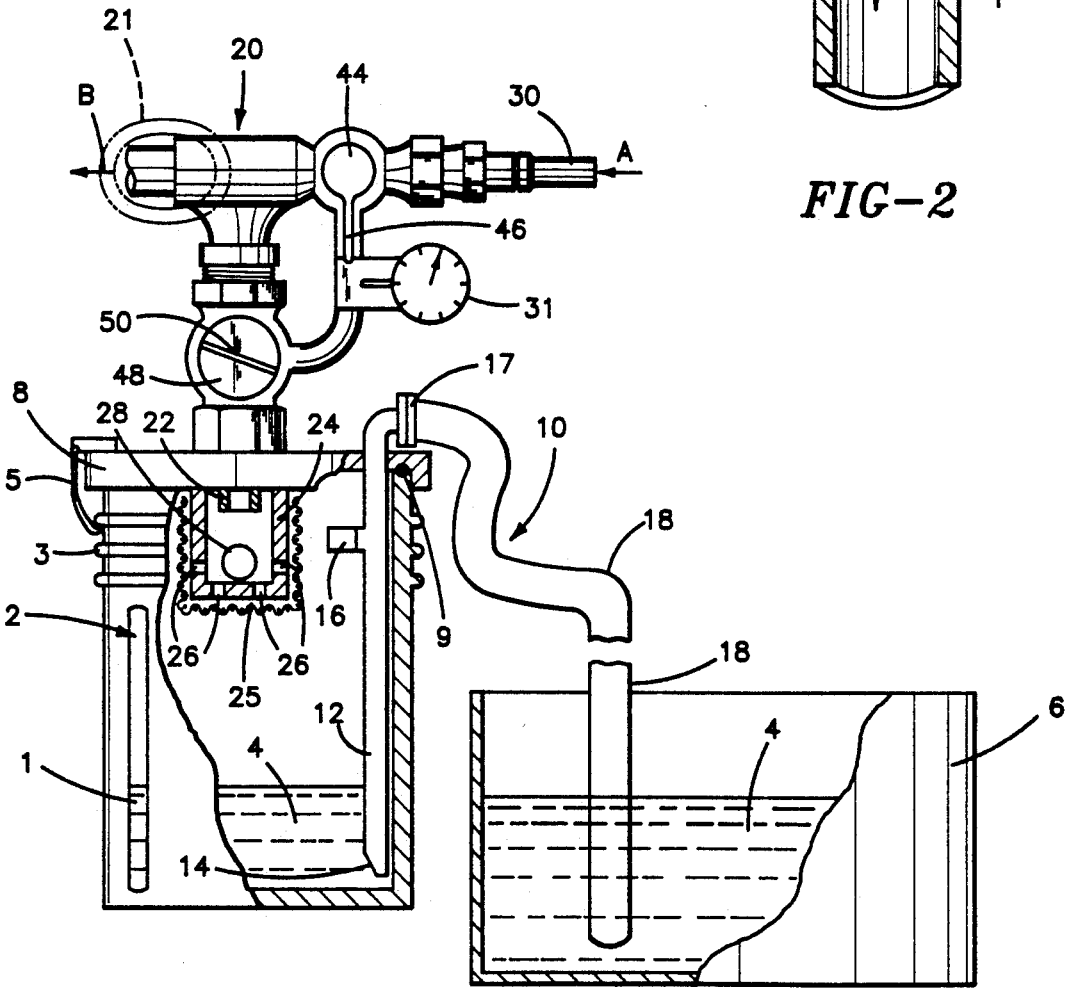
FIG. 1 is an elevational view, partially in section, of a preferred embodiment of a liquid transfer assembly formed in accordance with this invention.

Referring now to FIG. 1, there is shown a preferred embodiment of a liquid transfer assembly formed in accordance with this invention. The assembly includes a liquid transfer container 2 which can transfer a liquid such as water, oil, grease, or the like 4 either to or from another liquid receptacle or container 6. The receptacle 6 is schematically illustrated as a tank, however, it will be understood that the receptacle 6 can be an automobile radiator, an oil pan, transmission fluid housing, storage tank, or any other liquid receptacle to or from which the contained liquid is to be transferred. The container 2 may include a sight gauge 1 whereby the liquid level in the container 2 can be monitored.

The transfer assembly preferably has all of its operating components mounted on a lid 8 carrying a sealing gasket 9 which can be snugly fitted onto the container 2, and can be used with a number of different containers, so long as they are of the same diameter. The container 2 is provided with a plurality of external flanges 3 which can be gripped by manually operable clamps 5 pivotally mounted on the rim of the lid 8 for tightly fastening the lid 8 to the container 2. The container 2 can thus be a conventional plastic bucket or pail of the type used for shipping bulk supplies of liquids. The assembly preferably uses a single inlet/outlet transfer line 10 for moving the liquid into and out of the container 2. The transfer line 10 includes a tube 12 which is mounted on the lid 8, and which extends downwardly toward the bottom of the container 2. The lower end 14 of the tube 12 opens into the container 2, and the tube 12 is preferably provided with a branch check valve 16 which is operable to provide an auxiliary inward flow path to the interior of the container 2 from the tube 12. This additional flow path is not essential, but it enables the container 2 to fill faster, because the flow of liquid from the container 6 to the container 2 will slow down as the liquid level rises in the container 2 if the auxiliary flow path is not present. A hose 18 is fitted onto the tube 12 by means of a quick connect/disconnect fitting 17, and extends into the container 6. Different diameter hoses 18 can be used with the device.

A valve housing 20 is mounted on the lid 8 and communicates with the interior of the container 2 via a tube 22 which opens through the lid 8. A cage 24 having fluid passages 26 formed therein is mounted on the inner surface of the lid 8, and surrounds the tube 22. A filter screen 25 may be fitted onto the cage 24 to prevent liquid-entrained particulate matter from entering the valve assembly. A gravity operated float-type check ball valve 28 is disposed in the cage 24 in axial alignment with the tube 22. The check valve 28 is operable to block the tube 22 when the level of the liquid 4 in the container 2 reaches a predetermined height, thereby interrupting the vacuum source and preventing further liquid from being transferred into the container 2. When a positive air flow into the tube 22 is established, the ball 28 will be forced away from its shut-off position thereby permitting the establishment of a positive pressure in the container 2, and the transfer of liquid out of the container 2. An air passage fitting 30 is mounted on the valve housing 20 and adapted to be secured to a compressed air line (not shown) so that a stream of compressed air can be directed into the valve housing 20 in the direction indicated by the arrow A.

An internal valving system, which is described in greater detail hereinafter, controls the flow path that the compressed air stream takes through the valve housing 20. A pressure regulator 31 may be included to control the pressurization of the air going into the container 2. The regulator 31 need not be used if a positive pressure modulating check valve, as described hereinafter, is used. Care should be taken to ensure that the positive pressure in the interior of the container 2 should be less than about 20 lbs; and that the pressure of the compressed air stream from the compressor, or other compressed air source, to the venturi should stay within the range of about 25 lbs to about 170 lbs, depending upon the material or structure of the container 2, so that the container 2 will not collapse under the vacuum imposed therein by the stream of air passing through the venturi. Obviously, certain plastic containers cannot withstand high negative pressures, while certain steel containers can. Pressure modulating valves, both positive and/or negative, such as those described hereinafter in detail, can be incorporated into the system as required.

The valving system provides two basic flow paths for the compressed air stream, one of which directs the air stream through the valve housing 20 so as to exit the latter along the path of the arrow B, and the other of which diverts the air stream into the container 2, through the tube 22. A suitable air filter 21 (shown in phantom) may be used with the system to filter the stream of air exiting from the valve housing 20. The first air flow direction will create a negative pressure in the container 2 which is operable to draw the liquid 4 from the container 6 into the container 2; and the second air flow direction will create a positive pressure in the container 2 which is operable to force the liquid 4 from the container 2 into the container 6. In either case, the line 10 is operable to transfer the liquid from one container to the other.

Figure 2:
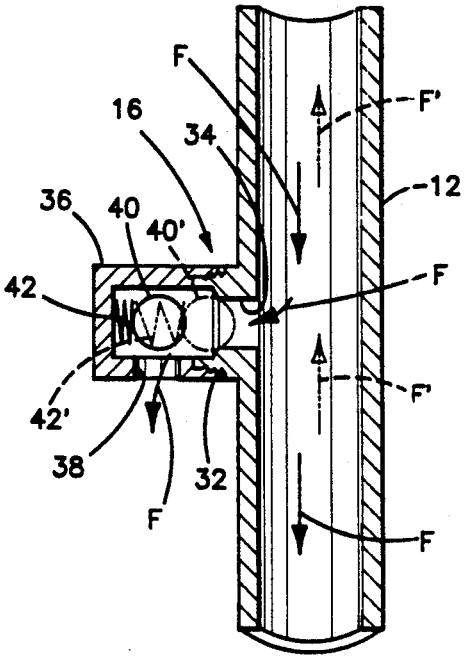
FIG. 2 is a fragmented sectional view of the bypass valve portion of the assembly of FIG. 1.

Referring to FIG. 2, details of the branch check valve 16 are shown. The tube 12 is formed with a threaded nipple 32 having a passage 34 opening into the bore of the tube 12. A hollow cap 36 having a lateral opening 38 is screwed onto the nipple 32. A ball check 40, which is biased by a spring 42 toward the passage 34, is mounted in the cap 36. The purpose of the valve 16 is to provide an auxiliary flow path for liquid being transferred into the container 2 through the tube 12. As the liquid 4 is transferred into the container 2, the liquid level therein rises, and the weight of the liquid 4 in the container 2 increases so as to increase the force needed to move the liquid 4 into the container 2 through the lower end 14 of the tube 12.

At a certain liquid level, the pressure of the liquid in the tube 12, and the degree of negative pressure generated in the container 2 will combine to force the ball check 40 against the spring 42 and allow the liquid 4 to flow into the container 2 through the passage 34 and the opening 38, as shown in FIG. 2. FIG. 2 illustrates the positions of the ball 40, spring 42; and the flow direction arrows F, in solid lines when the liquid is being transferred into the container 2; while the positions 40' and 42' of the ball and spring respectively; and the liquid flow direction arrows F' are shown in phantom lines for the liquid-out condition. Thus the check valve 16 will be open when the liquid is moving in the direction of the arrows F; and it will be closed when the liquid is moving in the direction of the arrows F'.

Figure 4:
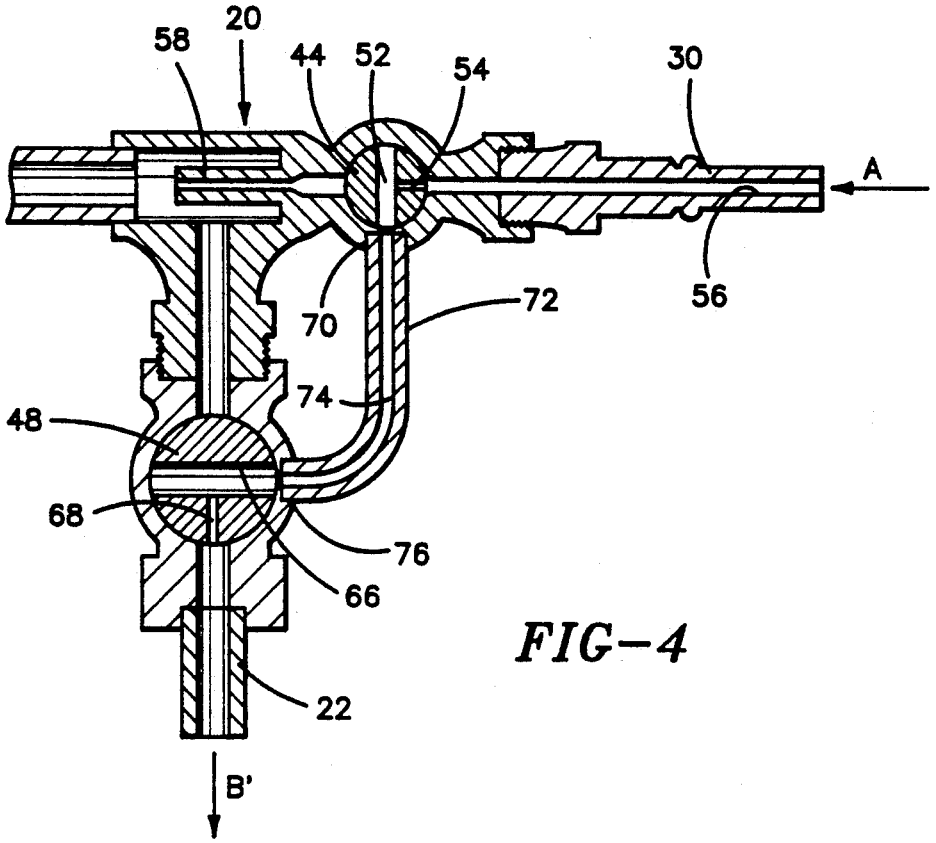
FIG. 4 is sectional view similar to FIG. 3, but showing the valve assembly in its positive pressure configuration.
Figure 3:
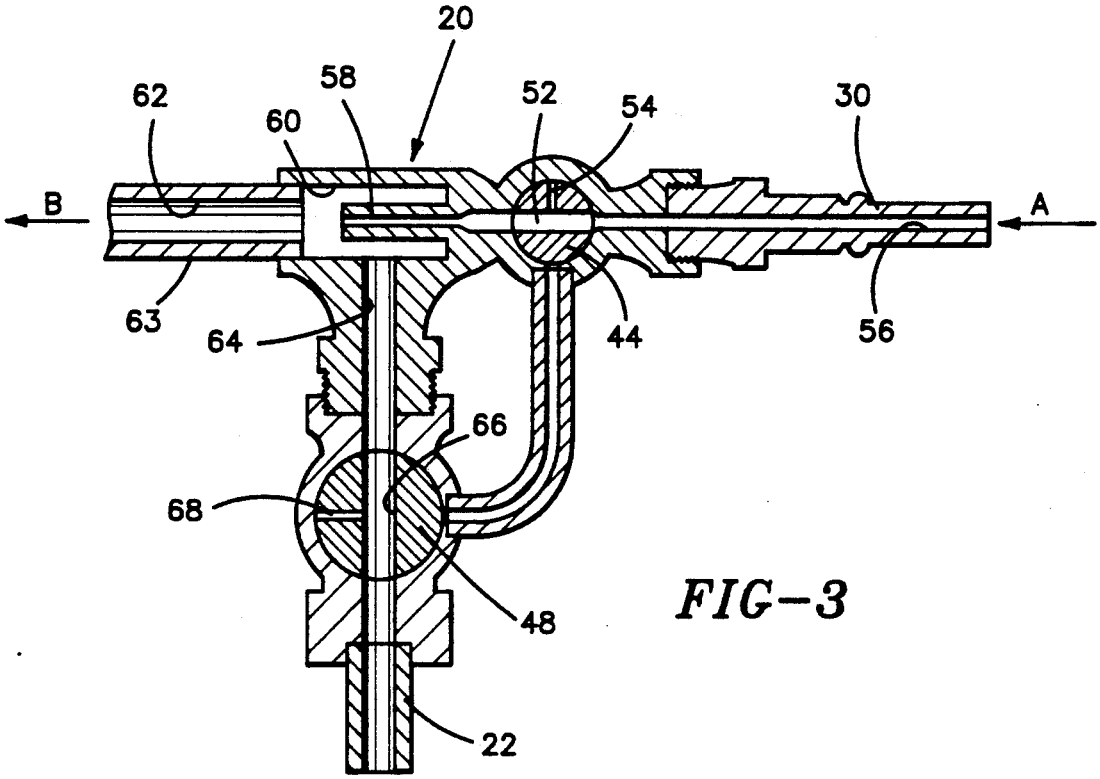
FIG. 3 is a sectional view of the valve assembly of FIG. 1 showing the latter in its negative pressure configuration.

Referring now to FIGS. 1, 3 and 4, internal details of the valves in the valve in the valve housing 20 are shown. The valve assembly in the valve housing 20 includes a first valve 44 having an external handle 46; and a second valve 48 having an external handle 50. Both valves 44 and 48 are manually operable to control the direction of air flow, and thus liquid transfer flow, in the system. FIGS. 3 and 4 show the valve assembly in its opposite operating modes.

Considering FIG. 3 first, the valves 44 and 48 are positioned so as to draw a vacuum in the container 2 so that the liquid will be transferred into the container 2. The valve 44 has a first through passage 52 passing diametrically through the valve 44, and a second Tee passage 54 which extends radially from the passage 52 through the valve side wall. An internal passage 56 runs from the pressure hose fitting 30 to the valve 44. Downstream of the valve 44 there is a constricted venturi nozzle 58. With the valve 44 positioned as shown in FIG. 3, the air stream will flow through the venturi nozzle 58 and out of the chamber 60, as indicated by the arrow B, through the outlet passage 62 in a tube 63 which may be inserted into the chamber 60. Different sized tubes 63 may be interchangeably used in the system so as to vary the extent of the negative pressure created by the venturi nozzle 58. The smaller the diameter of the passage 62, the greater the resultant negative pressure. The resultant venturi stream creates a negative pressure in the chamber 60, and in the downwardly directed passage 64 which leads to the valve 48. The valve 48 also includes a diametric through passage 66, and a radial Tee passage 68 communicating with the through passage 66. The valve 48 is positioned so as to connect the passage 64 with the tube 22. With the valves 44 and 48 positioned as shown in FIG. 3, a vacuum is drawn in the container 2, thereby transferring the liquid 4 into the container 2.

Considering FIG. 4 next, the valves 44 and 48 are positioned so as to produce a positive pressure in the container 2, so that the liquid 4 will be transferred out of the container 2. To this end, the valve 44 is rotated 90 degrees in the clockwise direction to bring the Tee passage 54 into alignment with the compressed air inlet passage 56, and to bring the through passage 52 into alignment with a passage 74 in a conduit 72 which connects the valve 44 with the valve 48 through ports 70 and 76. Likewise, valve 48 is rotated 90 degrees in the counter clockwise direction to bring the through bore 66 into alignment with the passage 74 and port 76, and to bring the Tee passage 68 into alignment with the tube 22. The aforesaid rotation of the valves 44 and 48 blocks the air stream from reaching the venturi nozzle 58, and instead directs the air stream into the container 2 through the tube 22. The Tee passage 54 in the valve 44 has a relatively small diameter, as shown in FIGS. 3 and 4. This restricted diameter allows the device to be used without a positive pressure regulator, and provides an inherent air pressure reduction at the valve 48, thereby reducing the flow of air into the container 2. The valve 44 may be positioned downstream of the conduit 72 so as to constantly pressurize the upstream side of the valve 48. In such a case, the valve 44 would not require a radial Tee passage at all, but merely the diametric through passage.

Figure 5:
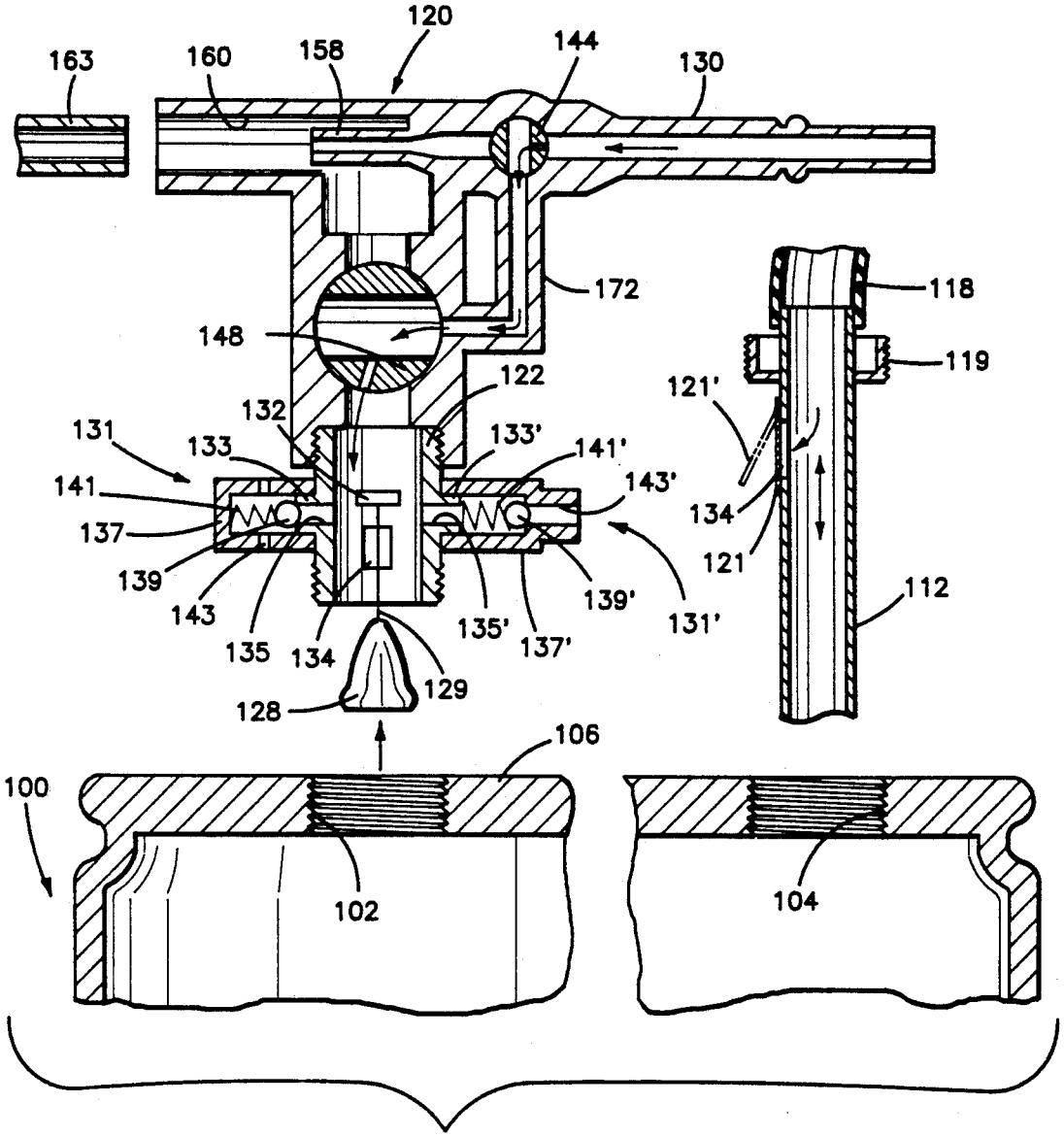
FIG. 5 is a fragmented exploded sectional view of a modified embodiment of the invention adapted for releasable securement to a standard fifty five gallon drum.

Referring now to FIG. 5, there is shown a modification of the device that can be used in conjunction with standard fifty five gallon drums. The drum 100 is typically provided with a pair of internally threaded openings 102 and 104 in its top wall 106. The valve housing 120 has essentially the same components as those previously described in connection with the embodiments of the invention shown in FIGS. 1–4. The two valves 144 and 148 are selectively operable to control the compressed air stream through the fitting 130 to the venturi nozzle 158, chamber 160 and outlet tube 163, or through the connection 172 to the drum tube 122. The tube 122 is externally threaded so as to be able to be securely screwed into the threaded opening 102 in the drum 100. The float closure valve body 128 is mounted on a rod 129 having an upper transverse catch 132. The rod 129 passes through a spider 134 mounted in the bore of the tube 122. The catch 132 prevents the rod 129 and float 128 from disengaging from the tube 122 by reason of the spider 134, however, the float 128 is able to move upwardly in the tube 122 so as to be able to seal the lower end of the tube 122 when the level of the incoming liquid rises to the top 106 of the drum 100. Prior to such a condition being reached, the float 128 will be suspended in the upper end of the drum 100 due to the rod 130 and spider 132. An automatic shut-off of the incoming transfer of liquid is thus achieved when the drum 100 is filled.

The tube 112 is mounted in an externally threaded fitting 119 which can be tightly screwed into the threaded opening 104, and the hose 118 is mounted on the tube 112. The tube 112 can extend substantially to the bottom of the drum 100 in the event that liquid is to be transferred out of the drum 100 through the tube 112, or it can merely extend a short distance down into the drum in the event that the liquid is to be transferred only into the drum 100. When the tube 112 is to extend a substantial distance down into the drum 100, an alternate entryway may be provided near the top of the tube 112 by means of a flap valve 121 which is spring-loaded so as to normally close a lateral opening 134 in the tube 112. When an appropriate liquid flow pressure is reached, the flap valve will be forced to the open position 121' (shown in phantom) to allow the liquid to enter the drum 100 through the opening 134. After a drum 100 has been filled with a liquid to be transported elsewhere; or stored; or discarded, the original equipment threaded plugs can be screwed into the openings 102 and 104 to seal and permit safe transport of the filled drum 100.

When the assembly is to be used to transfer liquid out of the drum 100, and wherein a pressure regulator 31 is not used in the line 172, a pressure bleed valve assembly 131 may be incorporated into the assembly to ensure that the liquid in the drum 100 will not be expelled therefrom from the hose 118 with too great a force. The valve assembly 131 may include a nipple 133 about a lateral opening 135 in the tube 122 above the external threads on the tube 122. A cap 137 contains a check ball 139 biased toward the opening 135 by a spring 141. Lateral openings 143 are formed in the cap 137 downstream of the opening 135 and open into the ambient surroundings. When the positive pressure in the tube 122 exceeds a preset level, the ball 139 will be moved away from the opening 135 compressing the spring 141 to bleed air from the tube 122. This controls the pressure in the drum 100 whereby the liquid flow rate from the drum 100 will not exceed a target value. A negative pressure bleed valve 131' with similar component parts 133', 135', 137', 139', 141', and 143' can be mounted on the tube 122 to provide a negative pressure bleed in the event that a threshold negative pressure is reached in the drum 100. These bleed valves 131 and 131' can also be mounted on the container cover in the embodiments of FIGS. 1–4 of the device.

Figure 7:
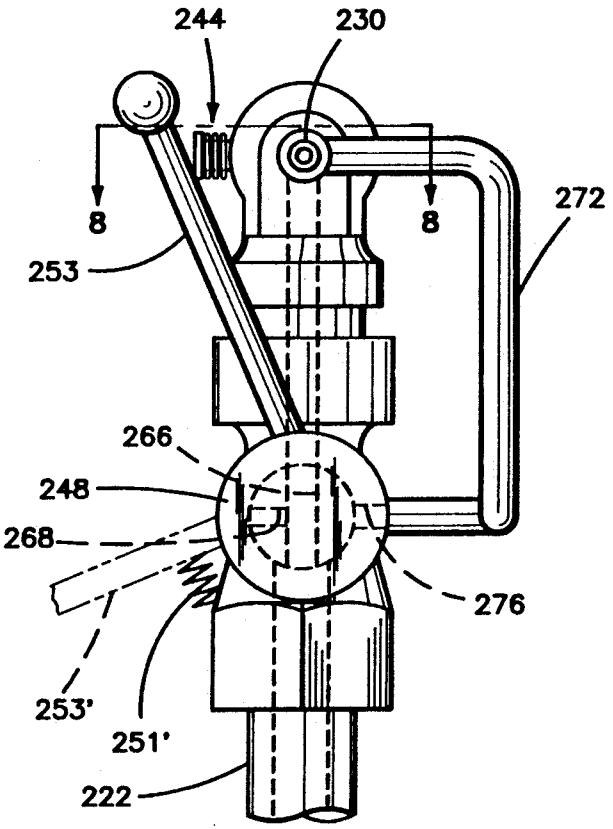
FIG. 7 is an end elevational view of the valve assembly of FIG. 6 as seen from the right hand side of FIG. 6.
Figure 8:
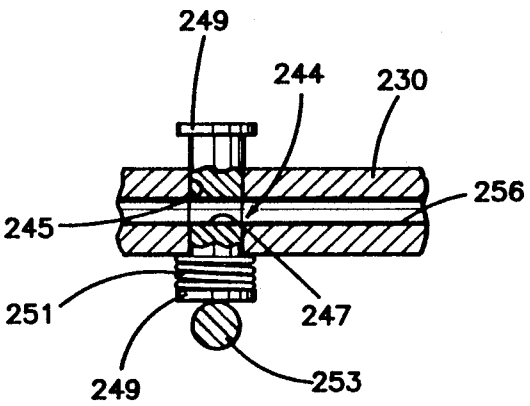
FIG. 8 is a sectional view taken along line 8—8 of FIG. 7.
Figure 6:
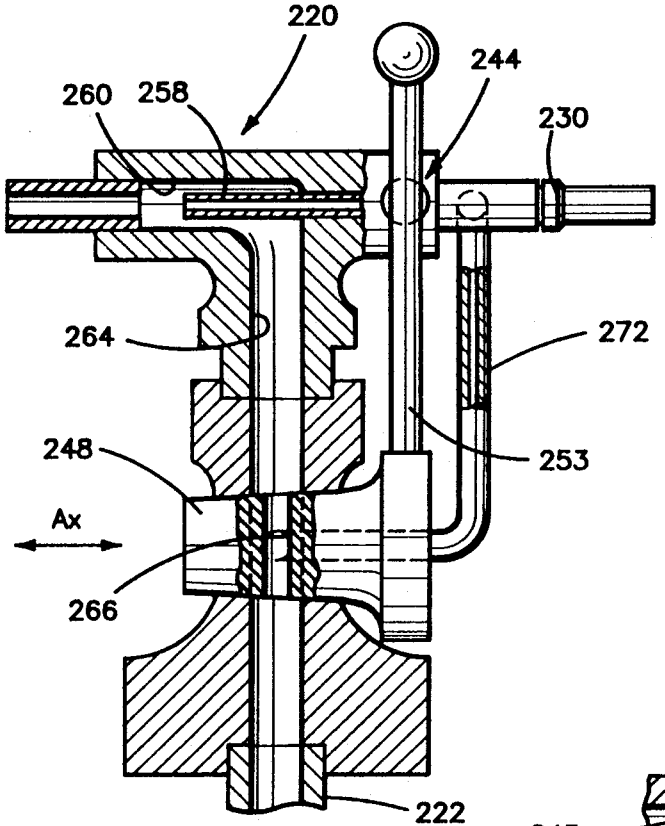
FIG. 6 is a sectional view similar to FIGS. 3 and 4, but showing an alternative embodiment of the valve assembly which requires a single manipulation of the valve actuator to change the system from positive to negative, and return.

Referring now to FIGS. 6–8, there is shown an embodiment of the invention wherein actuation of one of the valves controls operation of the other valve. The valve assembly 220 is generally similar to the assemblies described hereinbefore, in that a valve 244 controls air flow from the air passage fitting 230 to the venturi nozzle 258; and a valve 248 controls the creation of the negative and positive pressures in the transfer container. The valve 244 is a reciprocally slidable poppet valve, and the valve 248 is a rotating valve which rotates about an axis $A_x$ which axis is perpendicular to the direction of movement of the poppet valve 244.

Referring to FIG. 8 the valve 244 is mounted in a cross bore 245, which cross bore 245 intersects the hose fitting passage 256. The valve 244 has an internal passage 247, and is provided with a pair of end flanges 249 which limit the extent of reciprocating movement of the valve 244. A spring 251 is mounted on the valve 244 and serves to bias the valve 244 to either an open or a closed position. In the version shown in FIG. 8, the spring 251 biases the valve 244 toward a closed position wherein the passages 247 and 256 are not aligned, whereby the valve 244 prevents the compressed air from flowing through the venturi 258.

Referring to FIGS. 6 and 7, the valve 248 includes the diametric through passage 266 and the radial Tee passage 268. The valve 248 is provided with an operating handle 253 which extends radially of the axis of rotation $A_x$ and which is long enough to contact the poppet valve 244, as shown in FIGS. 7 and 8. The valve 248, as shown in FIGS. 6 and 7 is rotated to a position which brings the through passage 266 into alignment with the negative pressure passage 264 and with the venturi chamber 260.

This takes the Tee passage 268 out of alignment with the tube 222, and out of play. When the handle 253 is brought to this position, it contacts the poppet valve 244 and forces the latter to the venturi-open position, as shown in FIG. 8. Thus the device will be operable to transfer liquid into the transfer container when the handle 253 is in the position shown in FIG. 7. Due to the spring 251, the handle 253 must be manually held in the position shown in FIG. 7 in order to continue to draw liquid into the transfer container.

If one were to accidentally or intentionally release the handle 253, the spring 251 will move the poppet valve 244 to the closed position, wherein the passage 256 will be blocked from allowing the compressed air stream to flow to the venturi 258. In the aforesaid released position, there will be no continuing vacuum applied to the transfer container, nor will there be any positive pressure applied to the transfer container. When the valve 244 is in the closed position, the compressed air stream will flow through the connection 272 to the port 276. When the handle 253 is subsequently moved counter-clockwise to the position 253', and manually held there, as shown in phantom in FIG. 7, the through passage 266 will be moved into alignment with the port 276, and the Tee passage 268 will be aligned with the tube 222, so as to allow the compressed air stream to flow from the connection 272, through the port 276, and through the valve 248 into the transfer container, to transfer the liquid out of the container. A spring 251' will preferably be present to bias the handle 253 away from the positive pressure position 253' so that the device will not apply a positive pressure to the container if the handle 253 is intentionally or accidentally released by the operator of the device. The device is therefore always biased to the neutral position.

It will be readily appreciated that the above-described assembly has many advantages and a wide range of practical utility not possessed by the systems shown in the prior art. For example, the system of this invention can be used with small transfer hoses that can be inserted directly into parts of engines, automobiles, boats, tractors, or the like, which are to be drained of a fluid, or filled with a fluid. The transfer tube can be inserted directly into a transmission fluid filler tube on an automobile, and the D transmission fluid can be removed from the transmission via the filler tube. Oil can be removed from an engine block through the filler plug orifice. Inboard boat motors can be drained of engine oil through the filler plug orifice. Ninety weight gear oil can be transferred from truck transmissions through the filler orifice. A car radiator can be drained through the top without having to open the drain pitcock, thereby eliminating the risk of spilling antifreeze. The device can also be used as a convenient and mess-free filler assembly in areas presently requiring funnels or other adjuncts, such as transmissions, radiators, engine blocks, and the like. Environmentally harmful liquids such as antifreeze, greases, and oils which are accidentally spilled can be vacuumed up with the device without the need of liquid absorbants. If necessary, the receiving container can be fitted with an external sight gauge so that the liquid level in the transfer container can be monitored.

Since many changes and variations of the disclosed embodiments of the invention may be made without departing from the inventive concept, it is not intended to limit the invention otherwise than as required by the appended claims.

What is claimed is:

1. An assembly for transferring a liquid from one container to another, said assembly comprising:

a) a transfer container;

b) a lid for said transfer container, said lid being removably connected to said transfer container and operable to close off and seal an upper open end of said transfer container;

c) a transfer tube mounted on said lid, said transfer tube forming a liquid flow path into said transfer container; and d) pressure control means mounted on said lid, said pressure control means being operable to control a stream of compressed air to change the air pressure in said transfer container, said pressure control means comprising:

i) a venturi nozzle opening into a downstream chamber;

ii) a bypass conduit means upstream of said venturi nozzle for directing the stream of compressed air away from the venturi nozzle;

iii) an air passage tube opening into the transfer container through said lid;

iv) a first valve interposed between said air passage tube and said downstream chamber, said first valve being movable between a first position interconnecting said air passage tube with said downstream chamber, and a second position interconnecting said air passage tube with said bypass conduit means;

v) a second valve upstream of said venturi nozzle, said second valve being movable between a first position interconnecting said venturi nozzle with the compressed air stream so as to create a negative pressure in the transfer container when said first valve is concurrently in its first position; and a second position disconnecting said venturi nozzle from the compressed air stream and diverting the compressed air stream into said bypass conduit means so as to create a positive pressure in the transfer container when said first valve is concurrently in its second position; and e) a check valve operably connected to said air passage tube which check valve is operable to close said air passage tube when the liquid in the transfer container reaches a predetermined level to interrupt air flow from the transfer container.

2. The assembly of claim 1 wherein said check valve includes a porous cage surrounding the air passage tube, which cage allows entry of the liquid being transferred into the transfer container into said cage; and a closure float in said cage which float is buoyant in said liquid, and which float is operable to close the air passage tube when the liquid in the transfer container reaches said predetermined level.

3. The assembly of claim 1 wherein said transfer tube includes a branch check valve which provides a complementary liquid flow passage into the transfer container when the negative pressure in the transfer container reaches a predetermined level.

4. The assembly of claim 1 wherein said transfer tube provides the only liquid flow path into and out of said transfer container.

5. The assembly of claim 1 further including pressure bleed valve assembly means operable to automatically limit the extent of possible positive and negative pressure in said transfer container.

6. The assembly of claim 1 wherein said transfer tube extends from said lid to the bottom of said transfer container.

7. The assembly of claim 1 further comprising a quick connect/disconnect fitting interconnecting a liquid transfer hose with said transfer tube which enables use of different diameter transfer hoses with the assembly.

8. The assembly of claim 1 wherein said first valve has a manually operable operating handle which is used to move said first valve between its first and second positions, said handle being operable to contact, and concurrently operate said second valve, to move the latter between its first and second positions whereby the position of the operating handle dictates the flow of the compressed air stream through the pressure control means.

9. The assembly of claim 8 wherein said second valve is a spring biased valve which is biased toward an open or closed position.

10. The assembly of claim 8 further comprising spring means operable to bias said handle to neutral operating positions when said handle is manually released.

11. The assembly of claim 1 further comprising pressure-actuated bleed valve means operable to control the maximum negative or positive pressure achievable in said transfer container.

12. A transfer assembly for moving liquids from one container to another, wherein one of said containers has a closed top cover with a preformed internally threaded opening therein which is adapted to be secured to said transfer assembly, said transfer assembly comprising:

a) an air tube having external threads for threadedly connecting said air tube to the threaded opening in said one container;

b) pressure control means mounted on said air tube, said pressure control means being operable to control a stream of compressed air to change the air pressure in said air tube and in said one container, said pressure control means comprising: a venturi nozzle opening into a downstream chamber; a bypass conduit means upstream of said venturi nozzle for directing the stream of compressed air away from the venturi nozzle; a first valve interposed between said air tube and said downstream chamber, said first valve being movable between a first position interconnecting said air tube with said downstream chamber, and a second position interconnecting said air tube with said bypass conduit means; and a second valve upstream of said venturi nozzle, said second valve being movable between a first position interconnecting said venturi nozzle with the compressed air stream so as to create a negative pressure in the air tube when said first valve is concurrently in its first position; and a second position disconnecting said venturi nozzle from the compressed air stream and diverting the compressed air stream into said bypass conduit means so as to create a positive pressure in the air tube when said first valve is concurrently in its second position; and c) a check valve operably connected to said air tube which check valve is operable to close said air tube when the liquid in said one container reaches a predetermined level to interrupt air flow into said air tube.

13. The assembly of claim 12 further comprising a transfer tube mounted in an externally threaded plug which is adapted to be threaded into a second preformed internally threaded opening in said one container top, said transfer tube being operable to form a liquid flow path into said one container.

14. The assembly of claim 13 wherein said transfer tube includes a branch check valve which provides a complementary liquid flow passage into said one container when the negative pressure in said one container reaches a predetermined level.

15. The assembly of claim 13 wherein said transfer tube provides the only liquid flow path into and out of said one container.

16. The assembly of claim 13 further comprising a quick connect/disconnect fitting interconnecting a liquid transfer hose with said transfer tube which enables use of different diameter transfer hoses with the assembly.

17. The assembly of claim 12 wherein said first valve has a manually operable operating handle which is used to move said first valve between its first and second positions, said handle being operable to contact, and concurrently operate said second valve, to move the latter between its first and second positions whereby the positions of the operating handle dictates the flow of the compressed air stream through the pressure control means.

18. The assembly of claim 12 further comprising pressure-actuated bleed valve means operable to control the maximum negative or positive pressure achievable in said one container.

19. An assembly for transferring a flowable material from a source thereof, said assembly comprising:

a) a container for receiving the transferred material;

b) a venturi nozzle;

c) an air passage for directing a flow of compressed air into the venturi nozzle;

d) a negative pressure chamber connected to the venturi nozzle to receive a stream of compressed air flowing from the venturi nozzle;

e) a first passage connecting the negative pressure chamber with the interior of the container;

f) a material transfer line for interconnecting the interior of the container with the flowable material source;

g) means for preventing material transferred into the container from entering said first passage; and h) valve means for selectively controlling the flow of compressed air into said venturi nozzle.

20. An assembly for transferring a flowable material from a source thereof, said assembly comprising:

a) a container for receiving the transferred material;

b) a venturi nozzle;

c) an air passage for directing a flow of compressed air into the venturi nozzle;

d) downstream means connected to the venturi nozzle for receiving a stream of compressed air from the venturi nozzle;

e) a first passage connecting said downstream means with the interior of the container;

f) a material transfer line for interconnecting the interior of the container with the flowable material source;

g) means for preventing material transferred into the container from being entrained in said compressed air stream; and h) valve means for selectively controlling the flow of compressed air into said venturi nozzle.

* * * * *